United States Patent [19]

Simmons

[11] 4,184,706

[45] Jan. 22, 1980

[54] BULK TOBACCO CONTAINER AND AIR DIFFUSER THEREFOR

[75] Inventor: Roy Z. Simmons, Greenville, N.C.

[73] Assignee: Harrington Manufacturing Company, Lewiston, N.C.

[21] Appl. No.: 934,428

[22] Filed: Aug. 17, 1978

[51] Int. Cl.[2] ..... A24B 1/08

[52] U.S. Cl. ..... 294/5.5; 414/26

[58] Field of Search ..... 294/5.5; 34/201, 202, 34/231, 219; 217/42; 56/27.5; 432/500, 258; 131/134; 214/5.5

[56] References Cited

U.S. PATENT DOCUMENTS 3,932,946 1/1976 Johnson ..... 294/5.5

*Primary Examiner*—James B. Marbert

*Attorney, Agent, or Firm*—Mills & Coats

[57] ABSTRACT

The present invention relates to an improved bulk tobacco container of the type used to contain and support flue cured tobacco material for curing and drying, with the bulk tobacco container being of the box type and provided with an air diffuser or air channeling device disposed generally centrally within the container for channeling air directly from the bottom of the container to the tobacco material generally centrally located within the container. In particular, as oriented in an upright curing and drying position, the air channeling device or air diffuser extends upright from the lower portion of the bulk tobacco container and includes a side wall structure that defines an interior air passing area such that air may enter a lower open end portion of the air diffuser and move upwardly therethrough. Disposed about an upper side portion of the side wall structure of the air diffuser is air outlet openings that allow air to exit the air diffuser and be dispersed about and through the adjacent tobacco leaf material generally centrally located within the container for more efficient and effective curing and drying of the tobacco leaf material.

10 Claims, 3 Drawing Figures

BULK TOBACCO CONTAINER AND AIR DIFFUSER THEREFOR

The present invention relates to bulk tobacco curing and drying, and more particularly to bulk tobacco containers used for containing and supporting tobacco leaf material during the curing and drying of flue cured tobacco, the bulk tobacco container being particularly adapted to be received within a bulk tobacco barn where the tobacco leaf material therein is cured and dried by an appropriate curing and drying process.

BACKGROUND OF THE INVENTION

But in the last several years, flue cured tobacco farmers having turned to what is referred to as box or containerized curing. Box or containerized curing and drying of flue cured tobacco involves the use of a bulk tobacco container of the type shown and disclosed in U.S. Pat. No. 3,948,553. This type of bulk tobacco container is adapted to be filled directly in the field during the harvesting operation, after which tines are inserted through the volume of tobacco to support the same within the container and the container is rotated approximately 90 degrees and placed directly in a bulk tobacco curing and drying barn. When placed in the barn, the container supports a vertically continuous volume of tobacco leaf material with the leaves being randomly aligned such that in the normal curing and drying position within the barn the vertical depth of the volume of tobacco leaf material within the container substantially exceeds the leaf length of one leaf.

Tobacco leaf material can be properly and satisfactorily cured and dried in a box or container type structure, but in actual practice some farmers have experienced difficulty in achieving a good cure time after time. This is caused by certain factors, including variables such as leaf maturity, priming level on the stalk, and rainfall received by the crop during the season. In such cases, this requires the individual in charge of the curing and drying process to use this personal judgment and fundamental knowledge of flue cured tobacco curing and drying principles in curing and drying his crop. Moreover, good management practices have always been essential in curing and drying flue cured tobacco where the farmer desires to market top quality tobacco for his entire crop. Even with a small single tier rack of the type shown in the Hassler Patent, U.S. Pat. No. 3,105,713, it was and still is most important to uniformly load the rack or container such that air pockets are not present for air to escape through and by-pass certain portions of the tobacco leaf material within the rack or support structure.

Uniform loading of the box or container type support structure is not always achieved in practice. This is due, in some cases, to hastiness and carelessness. But even where good management practices are followed in loading bult tobacco containers, certain types of crops and certain particular primings do sometime present problems in curing and drying. In most cases, farmers have encountered difficulty in drying out the tobacco leaf material contained in the central or upper central areas of the container or box type curing structure. While there may be various reasons for this difficulty depending on the circumstances of the individual case, one common cause of such difficulty is due to the lack of a sufficient air flow through the tobacco leaf material in the central or upper central area of the container.

This lack of air flow is generally due to substantial portions of the air flow moving through the container escaping through air pockets or areas of less resistance within the container which usually is found located about the laterally spaced outer sides of the container.

In loading the container, the central or upper central area are usually more densely packed with tobacco leaf material than areas along the outer sides of the container. These side areas of less density tend to dry at a faster rate than the tobacco leaf material in the central area of the container, and the net effect is that the resistance to air flow through the container is significantly lower about the outer sides of the container than the resistance in the central areas. Thus, the vertically moving air within the container during the curing and drying process tends to move toward the less densely packed areas along the sides of the container and to move through the container such that a nonuniform flow of air through the container is present. It is thusly appreciated that without proper air flow through the central and upper central areas of the container that the tobacco leaf material within these areas of the container are not going to cure and dry properly, and consequently the final quality of the cure in these areas is poor, even if acceptable.

SUMMARY OF INVENTION

The present invention is an improved bulk tobacco container provided with an air diffuser or air channeling device for directly channeling air (without passing the air through the tobacco leaf material) to the central and upper central areas of the container. More particularly, the present invention entails an air diffuser or air channeling device that is adapted to be used in conjunction with a bulk tobacco container and which is generally oriented vertically within the bulk tobacco container, as viewed when the bulk tobacco container is in an upright curing and drying position, and wherein the air diffuser or air channeling device is particularly situated within the container such that it extends from a lower or bottom area thereof upwardly through the container. The air diffuser or air channeling device is of a generally closed construction to form an air directing or channeling device such as an air duct, but is provided with an air inlet opening about the lower end, and air outlet openings about an upper area thereof generally in the central area of the container. Consequently, it is appreciated that as air moves through the bulk tobacco barn and upwardly through the bulk tobacco container, that a portion of the air flow is directed directly into the air inlet end of the air diffuser or air channeling device, and this portion of the air is directed directly to the central or upper central area of the bulk tobacco container where the air is dispersed or diffused through the air outlet openings formed within the air diffuser or air channeling device. Thus, because the central area of the container is the area that generally surrounds the area occupied by said air outlet openings, air exiting from these air outlet openings is constrained to move through the tobacco leaf material generally disposed about the central area of the container.

In addition, the air diffuser or air channeling device becomes a divider type support that effectively divides the container and which may act to support tobacco leaf material thereover, which is particularly advantageous when the tobacco leaf material during the curing and drying process begins to wilt because in wilting the tobacco leaf material tends to fall and this, of course, disturbs the uniformity of the tobacco leaf material throughout the container.

It is, therefore, an object of the present invention to provide an improved bulk tobacco support structure of the container type wherein the bulk tobacco container will more efficiently and effectively dry tobacco leaf material disposed in the central or upper central areas thereof.

A further object of the present invention is to provide a bulk tobacco container of the general box type having an air channeling device associated therewith for effectively channeling air directly to the tobacco leaf material disposed within the central area of the container, and for dispersing and directing this channeled air generally uniformly through the bulk tobacco material within the central area of the container.

A further object of the present invention is to provide an air channeling device that is adapted to be situated within a box type bulk tobacco container, which is adapted to generally divide a portion of the container and to disperse air outwardly from opposite sides of the air channeling device in a direction generally perpendicular to the vertical movement of air through the container, after which the dispersed air from the air channeling device may generally move upwardly through the mass of tobacco leaf material disposed within the central area of the bulk tobacco container.

Another object of the present invention is to provide an air channeling device that is adapted to operate in conjunction with a box type bulk tobacco container that acts as a divider and support structure, whereupon when the bulk tobacco container is filled, the tobacco leaf material disposed over the air channeling device is generally supported thereby, so as to generally prevent the tobacco leaf material overlying the air channeling device from falling after wilting such as typically occurs in conventional box curing.

Still a further object of the present invention is to provide an air channeling device for a box type bulk tobacco container that is adapted to be strategically disposed within the container between laterally spaced sides thereof and to particularly disperse air outwardly from opposite sides where the dispersed air moves from the air channeling device in a direction generally perpendicular to the normal vertical flow of air through the container and up through the air channeling device.

Other objects and advantages of the present invention will become apparent from a study of the following description and the accompanying drawings which are merely illustrative of the present invention.

THE IMPROVED BULK TOBACCO CONTAINER AND AIR DIFFUSER THEREFOR

Figure 2:
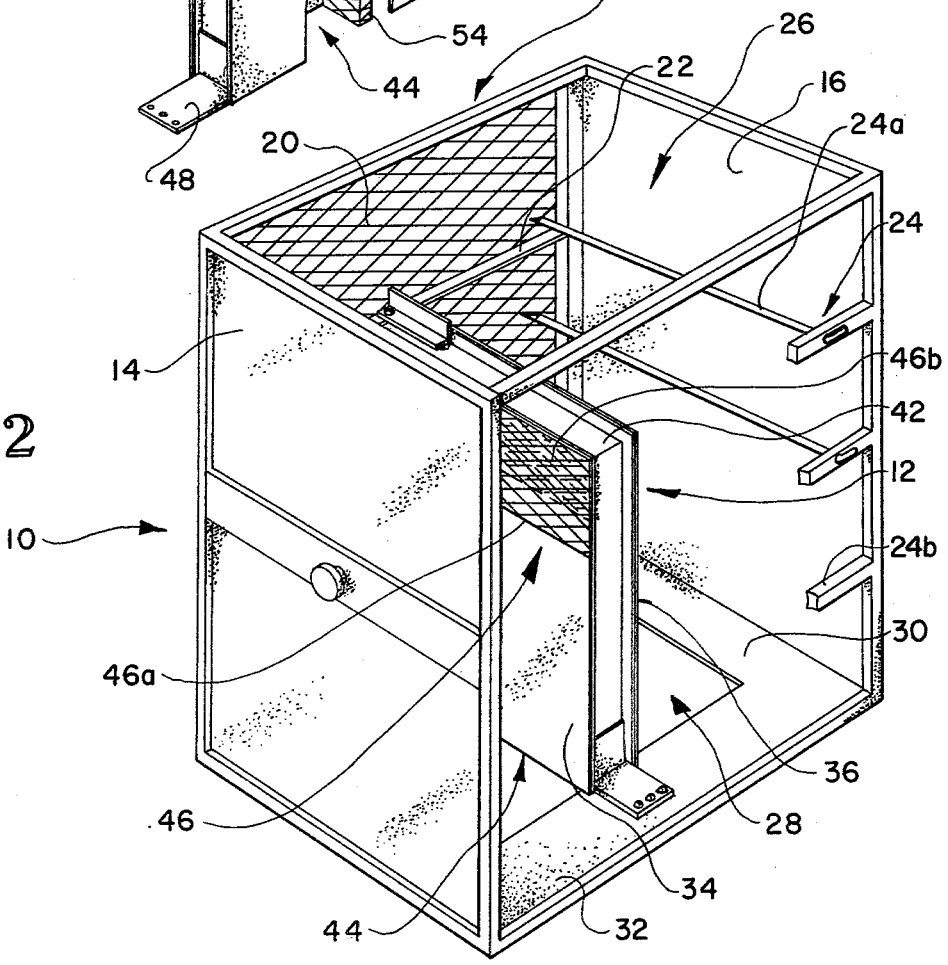
FIG. 2 is a perspective view of the improved bulk tobacco container of the present invention including the air channeling device or air diffuser shown in FIG. 1 incorporated therein, with a portion of the front retaining means of the box type bulk container being broken away for clarity.

With further reference to the drawings, particularly FIG. 2, the improved bulk tobacco container is shown therein and indicated generally by the numeral 10, and includes associated therewith the air diffuser or air channeling device of the present invention which is indicated generally by the numeral 12.

The bulk tobacco container 10 shown in FIG. 2 is of the conventional box type bulk tobacco container that is presently being communicatively produced and sold by Harrington Manufacturing Company, Lewiston, North Carolina. Those skilled in the art appreciate the basic structure of a conventional box type bulk tobacco container, but for further appreciation of the structure and function thereof, one is referred to the disclosures in U.S. Pat. No. 3,948,553, U.S. Pat. No. 4,045,066, and U.S. Pat. No. 3,935,959, all three of which are expressly incorporated herein by reference.

In the way of a general description of the bulk tobacco container 10, it is seen, as shown in FIG. 2, that the same includes a pair of imperforated laterally spaced side retaining means 14 and 16 that are joined about the back by back retaining means, indicated generally by the numeral 18. Conventionally, the back retaining means 18 may include a screen constructed of expanded metal 20 and a series of spaced apart cross members 22 that in practice function to support the remote end of a series of tines that extend front to rear through the bulk tobacco container that assist in supporting the bulk tobacco leaf material in the container.

Extending across the front of the bulk tobacco container and generally between the front edges of the side retaining means 14 and 16 is front retaining means indicated generally by the numeral 24. In this regard, it is conventional practice to provide a detachable tine frame that essentially acts as the front retaining means 24, and in conjunction with the detachable tine frame, there is provided a plurality of tines **24*a* that are adapted to be supported at one end by cross members 22*b* of the detachable tine frame, and at the rear or remote end by the plurality of cross members 22**, referred to above.

As viewed in FIG. 2, defined about the top area of the bulk tobacco container 10 is an open top area 26, and defined about the lower or bottom area of the container is an open bottom area 28 with the top and bottom areas being at least partially open in order that air circulating within a bulk tobacco barn can move vertically through the bulk tobacco container. In addition, it is also known to provide a series of baffles about the lower area 28 of the bulk tobacco container 10 in order to attempt to achieve a more uniform flow of air through the container with respect to the density of the tobacco leaf material within that container. In the embodiment illustrated in FIG. 2, the series of baffles include a pair of side baffles 30, each baffle being secured adjacent the inside of the side retaining means 14 and 16, and a front baffle 32 that extends along the front lower area of the container.

It is appreciated by those skilled in the art that the bulk tobacco container 10 just described above and as viewed in FIG. 2 is disposed in an upright normal curing and drying position. When the container is being filled, the back retaining means 18 becomes the bottom of the container, and the tine frame forming a part of the front retaining means 24 acts as the top of the container and is removable in order that the container can be filled from the top. It is conventional practice to fill the container in this filling position with the individual tobacco leaves falling flat one upon the other, and as the container is filled, it follows that the leaves would overlie adjacent leaves and may be spreaded throughout the container to form a uniform load. Once the bulk tobacco container 10 is loaded, it is rotated from its filling position to its upright curing and drying position, as shown in FIG. 2.

Figure 1:
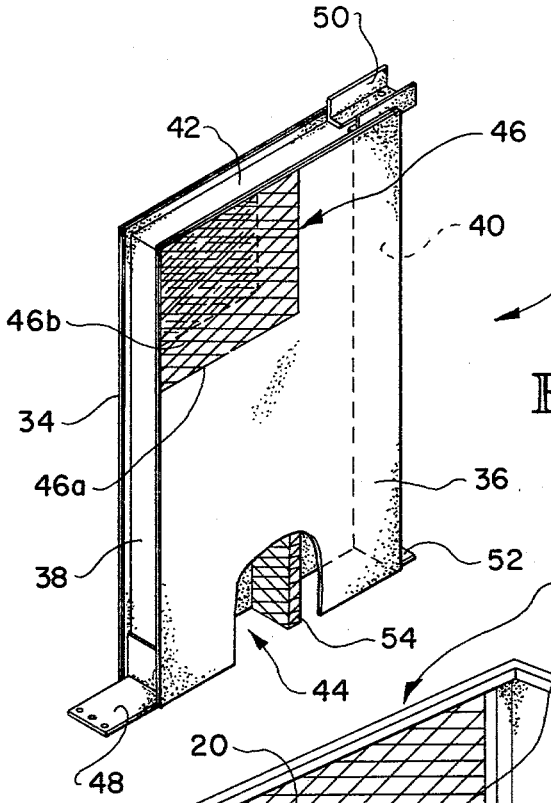
FIG. 1 is a perspective view of the air channeling device of the present invention that is particularly adapted to be used in conjunction with a box type bulk tobacco container, wherein a portion of the side wall structure of the air channeling device is cut away to better illustrate the structure thereof.

Forming a part of the improved bulk tobacco container 10 of the present invention is the air channeling device or air diffuser 12 shown in FIG. 1, and shown incorporated within the bulk tobacco container 10 in FIG. 2. It is appreciated that the air channeling device or air diffuser 12 generally acts as a divider in the bulk tobacco container 10 since in the design shown in FIGS. 1 and 2, the air diffuser or air channeling device is generally spaced between the side retaining means or panels 14 and 16, and is secured within the container such that the air diffuser generally extends fore-and-aftly through the container above the open bottom area 28. The particular position and the height of the air diffuser 12 may vary depending on the design and type of bulk tobacco container 10 being used in conjunction therewith. But in the present embodiment, it is appreciated that the air diffuser extends a height at least sufficient enough for the top portion thereof to reach the general central and upper central areas of the bulk tobacco container.

Viewing the air channeling device or air diffuser 12 in more detail, it is seen that the same includes a side wall structure that includes a pair of laterally spaced side walls 34 and 36 and front and rear side 38 and 40, respectively, which are all secured together to form and define a generally hollow air passing area therebetween. Secured between the top of the side walls 34 and 36 is a closed top or closed top end 42, while the bottom or lower end of the air diffuser 12 is at least partially open to define an inlet air opening 44.

Figure 3:
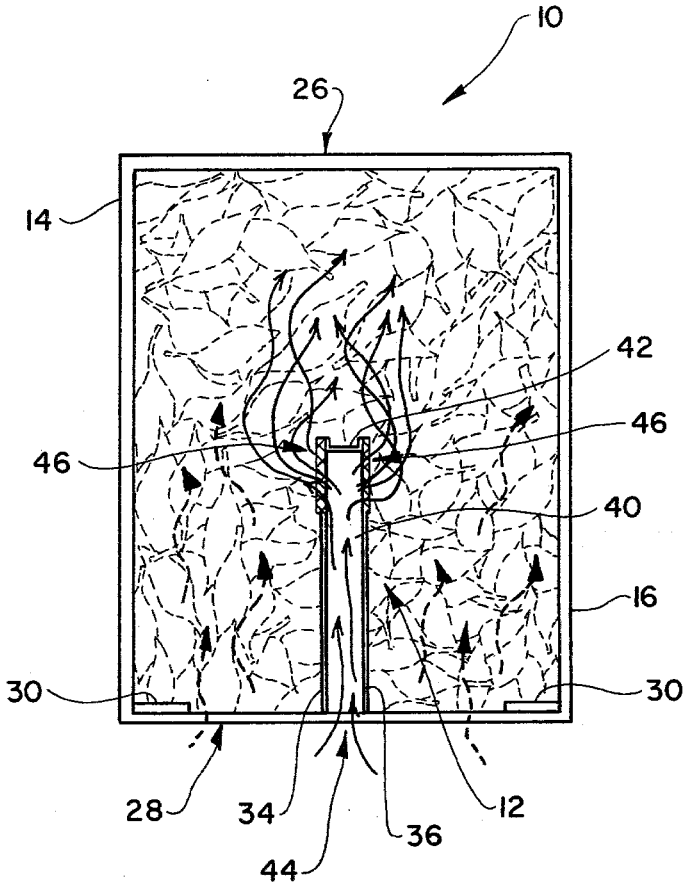
FIG. 3 is a diagrammatic sectional front elevational illustration of the bulk tobacco container with the air diffuser or air channeling device associated therewith particularly illustrating a typical pattern of air flow through the air diffuser and through the bulk tobacco material disposed thereover and in the generally central area of the container.

Formed in the upper portion of the side wall structure of the air channeling device or air diffuser 12 is outlet air opening means indicated generally by the numeral 46. The outlet air opening means 46 of the particular design illustrated in FIGS. 1, 2 and 3 is provided for in the front upper corner of each of the side walls 34 and 36 and each comprise an opening **46*a* formed in the respective side wall 34 or 36 along with a screen or expanded metal opening 46*b* provided for in the opening which allows air to escape and exit from the lateral side walls 34 and 36 forming a part of the side wall structure of the air diffuser or air channeling device 12**.

For additional support, an expanded metal strip 54, or other suitable support structure is provided within the interior or the air diffuser 12 and secured between the respective sides 34 and 36.

As previously noted, the air channeling device or air diffuser 12 is secured within the bulk tobacco container 10 as indicated in FIG. 2, and to accommodate this connection, a front connecting plate 38 is secured to the front side 38 of the air diffuser and is screwed or bolted or secured by other suitable means to the front baffle 32. A second pair of connecting brackets 50 and 52 are secured about the rear side of the air channeling device 12 and are connected in any suitable fashion to the back retaining means 18 of the bulk tobacco container.

In operation, the container 10 is rotated to its filling position where the back retaining means 18 assumes a bottom position, and tobacco leaf material is deposited within the container on each side of the air channeling device or air diffuser 12 and between the top of the air channeling device or air diffuser 12 and the top area 26 of the container. Tobacco leaf material is continued to be uniformly distributed within the bulk tobacco container around the air diffuser 12 until the bulk tobacco container is appropriately filled, at which point the tine frame is placed about the top of the bulk tobacco container 10 as then oriented. A series of tines are then inserted through the tobacco leaf material within the bulk tobacco container and are appropriately and conventionally supported between the front retaining means 20 and the back retaining means 18.

After this, the entire container 10 is rotated approximately 90 degrees to the position shown in FIG. 2 and the individual containers 10 are placed over a plenum in a conventional bulk tobacco barn in front to back relationship. During the curing and drying process, the bulk tobacco barn serves to circulate a system of air, heated as necessary to maintain the air at an appropriate temperature for the particular curing and drying schedule deemed appropriate or being used. It is conventional to circulate the air into the plenum underlying the bulk tobacco containers, and this air is forced up through the bottom open area 28 of each individual container and on up vertically through the tobacco leaf material disposed within the container. It is appreciated that in the curing and drying position, as indicated in FIG. 2, that the tobacco leaves lie in generally random vertical plane and this enables air to conveniently move vertically through the mass of tobacco leaves.

During the curing and drying process, a portion of the air that would ordinarily flow through each bulk tobacco container 10, flows into the lower air inlet opening 44 of the air diffuser and up within the side wall structure comprised of sides 34, 36, 38 and 40. Once the air reaches the top portion of the divider or air diffuser, it is diffused or dispersed out the outlet air opening means indicated generally by the numeral 46 toward the sides 14 and 16 of the bulk tobacco container. As the air is dispersed through the outlet air opening means, as shown particularly in FIG. 3, it is appreciated that the air is then constrained to move vertically through the mass of tobacco leaf material generally overlying the top of the air channeling device 12 and the tobacco leaf material disposed generally adjacent and slightly above and outwardly of the air outlet opening means 46 in each side wall 34 and 36 of the side wall structure of the air channeling device 12. Consequently, the air that is diffused and dispersed by the air channeling device 12 is directed to the critical area within the bulk tobacco container, that area being the center or upper central area (referred to as the upper central area) of a container where the tobacco is often most densely packed, and which is sometimes not fully and completely cured and dried in conventional box type container curing structures.

In addition, it is appreciated that the air channeling device or air diffuser 12 tends to support the tobacco leaf material disposed generally thereabove. This is quite important because during the curing and drying operation, the tobacco leaf material will tend to wilt and in doing so, has a tendency to fall and accumulate in a lower portion of the bulk container 10. This tends to compound the curing and drying problem because in falling the uniformity of the tobacco leaf material is further disturbed and air pockets are created that allow air being circulated through the container to escape without being totally effective in the curing and drying operation.

From the foregoing specification, it is apparent that the improved bulk tobacco container of the present invention and the air diffuser or air channeling device 12 therefor greatly increases the potential for the box type bulk tobacco container to be suitable means for curing and drying flue cured tobacco. It is further appreciated that the particular size and orientation of the air diffuser within the container and other such matters can be varied in accordance with the size and type of bulk tobacco container being used, such that the air being dispersed by the air channeling device or air diffuser 12 is dispersed in an area where the dispersed air effectively reaches the critical mass of tobacco leaf material disposed in the central and upper central areas of the container for curing and drying.

The terms "upper", "lower", "forward", "rearward", etc., have been used herein merely for the convenience of the foregoing specification and in the appended claims to describe the improved bulk tobacco container and air diffuser therefor and its parts as oriented in the drawings. It is to be understood, however, that these terms are in no way limiting to the invention since the improved bulk tobacco container and air diffuser therefor may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced herein.

What is claimed is:

1. In a container type bulk tobacco curing and drying structure which when filled and oriented in a normal curing and drying position is adapted to contain and support a continuous volume of tobacco leaf material where the vertical depth of the continuous volume of tobacco leaf material is greater than one leaf length and wherein this type of bulk tobacco container includes two laterally spaced side retaining means, a back retaining means extending across the back portion of said container, a front retaining means extending across the front of said container, tine means inserted through said container and the tobacco leaf material contained therein and between said front and back retaining means for supporting the tobacco leaf material within said container, and at least partial open top and bottom areas for allowing air to be forced vertically through said container and the mass of tobacco leaf material contained therein during the curing and drying process, the improvement comprising an air directing device disposed within said container type bulk tobacco curing and drying structure for directing air from the bottom of said container to the tobacco material located generally within the central area of said container, said air directing device comprising an upright housing structure disposed within said bulk tobacco container and extending from the bottom area of said container upwardly therefrom and disposed generally between said side retaining means of said bulk tobacco container, said housing structure including a side wall structure having top and bottom areas with the side wall structure defining an interior hollow air passing area therein and wherein said bottom area includes an air inlet opening formed therein for receiving air being forced into the at least partially open bottom area of said container and allowing the air to move upwardly through the interior of said wall structure, and wherein about the upper area of said side wall structure there is provided air outlet opening means that allow the air passing within the interior of said side wall structure to exit therefrom and to move through the tobacco material disposed about the generally central area of said container.

2. The improved bulk tobacco container with said air directing device, as set forth in claim 1, wherein the side wall structure of said upstanding housing includes two laterally spaced side walls that lie generally in parallel relationship to said side retaining means of said container, and wherein said air outlet opening means are provided about an area of each of said side walls with said air outlet opening means being spaced upwardly from the lower area of said container from said air inlet opening formed in the lower area of said side wall structure; and wherein the top of said housing structure is closed and wherein the area of said side wall structure extending below said air outlet opening means is also generally closed so as to require that air moving up through the interior of said side wall structure exit from said air outlet opening means.

3. The improved bulk tobacco container and air directing device of claim 2 wherein there is provided attaching means for attaching said air directing device to said back retaining means and about the bottom area of said container.

4. The improved bulk tobacco container and interior air directing device of claim 1 wherein said side wall structure includes a pair of laterally spaced generally solid walls that lie generally parallel to said side retaining means of said bulk tobacco container, and wherein said air outlet opening means are formed in an area of each of said side walls such that air moving vertically through said upstanding housing is directed through said exiting openings such that the pattern of air flow therefrom is generally perpendicular to the vertical air flow through the interior of said upstanding housing.

5. In a container type bulk tobacco curing and drying structure which when filled and oriented in a normal curing and drying position is adapted to contain and support a continuous volume of tobacco leaf material where the vertical depth of the continuous volume of tobacco leaf material is greater than one leaf length and wherein this type of bulk tobacco container includes two laterally spaced side retaining means, a back retaining means extending across the back portion of said container, a front retaining means extending across the front of said container, tine means inserted through said container and the tobacco leaf material contained therein and between said front and back retaining means for supporting the tobacco leaf material within said container, and at least partial open top and bottom areas for allowing air to be forced vertically through said container and the mass of tobacco leaf material contained therein during the curing and drying process, the improvement comprising an air diffuser disposed interiorly of said bulk tobacco container for directly channeling air from the bottom area of said container to the mass of tobacco material generally located centrally within said container, said air diffuser comprising an upstanding air channeling structure disposed generally midway between said side retaining means and said container and having a generally closed side wall structure that defines an interior air passing area therein, and further includes a closed top, and a bottom area disposed adjacent the bottom of said bulk tobacco curing container with the bottom of said air diffuser including an air inlet opening formed therein that is separate and distinct from the at least partially open bottom of said container for allowing air to enter and move vertically through the interior air passing area defined by said wall structure, said wall structure including two spaced apart side walls joined about the front and back by front and back walls, and wherein said side walls generally face said retaining means and lie in respective planes that extend generally in parallel relationship to said side retaining means, and wherein spaced upwardly from the lower area of said air diffuser at a height generally centrally of said container, there is provided air outlet opening means formed in each of said side walls facing said side retaining means such that air moving vertically through the interior air passing area may be directed from the air diffuser outwardly through said air outlet opening means in the side walls thereof to the mass of tobacco leaf material disposed about the central area of said bulk tobacco container.

6. The improved bulk tobacco container and interior air diffuser of claim 5 wherein said air diffuser is relatively thin compared to its height and extends from front to rear within said bulk tobacco container.

7. A box type bulk tobacco container having an interior air diffuser for directly directing air to the central located mass of tobacco material within said container during the curing and drying operation, said bulk tobacco container when filled and oriented in the curing and drying position is adapted to contain and support a continuous volume of tobacco leaf material where the vertical depth of the continuous volume of tobacco leaf material is greater than on leaf length, said bulk tobacco container comprising: two laterally spaced side retaining means; a back retaining means extending across the back portion of said container; a front retaining means extending across the front of said container; tine means inserted through said container and the tobacco leaf material contained therein and between said front and back retaining means for supporting the tobacco leaf material within said container; and at least partially opened top and bottom areas for allowing air to be forced and vertically through said container and the mass of tobacco leaf material contained therein during the curing and drying process; an air diffuser disposed generally between said side retaining means and including an upright housing having a closed top and open lower end portion disposed about the bottom area of said container and which extends upwardly through said container, said upright housing having a generally closed side wall structure that defines a generally hollow air passing area therebetween, and wherein said air diffuser means includes air outlet opening means formed about the side wall structure above the lower open end of said upright housing generally centrally within said container such that air entering said air inlet opening of said upright housing may move vertically therethrough and be diffused about said air outlet opening means formed within said side wall structure and through the bulk tobacco material disposed within the central area of said container about the area adjacent said air outlet openings.

8. The bulk tobacco container of claim 7 wherein said side wall structure of said upright housing includes two laterally spaced sides with each side facing a respective side retaining means of said container, and front and back wall portions that extend between said two laterally spaced sides to form a generally closed rectangular shaped cross sectional wall structure; and wherein said air outlet opening means is formed with each side wall above the lower area of said container and generally about the central area of said container such that air moving interiorly of said wall structure is diffused out of said air outlet opening means formed within the side walls of said wall structure of said upright housing.

9. In a box type bulk tobacco container of the type including two laterally spaced side retaining means, a back retaining means extending across the back portion of the container, front retaining means extending across the front of said container, tine means inserted through said container and the bulk tobacco leaf material contained therein between said front and back retaining means for supporting the tobacco leaf material within said container, and at least partially open top and bottom areas for allowing air to vertically move through said container and the mass of tobacco leaf material contained therein within the curing and drying process, the improvement comprising an inwardly disposed and vertically projecting divider assembly disposed generally between said side retaining means of said container and including an open lower end that lies in the area of said partially open bottom area of said container so as to define two separate and distinct openings about the bottom of said container, said upwardly projecting divider assembly including an open interior wall structure that projects upwardly from the lower portion of said container to an intermediate height therein so as to generally tend to divide the lower portion of said container between said side retaining means thereof, and wherein said open interior wall structure of said divider assembly is generally closed about the top and side portions thereof to form a generally closed air channeling device that is provided with air outlet opening means disposed about sides thereof that face said side retaining means of said container with said air outlet opening means being particularly spaced such that air being directed therefrom is directed generally outwardly and upwardly through the central mass of tobacco leaf material disposed within said container.

10. The improved bulk tobacco container of claim 9 wherein said wall structure of said divider assembly comprises: a pair of laterally spaced side walls that generally extend in parallel relationship with said side retaining means of said container; front and back sides secured between said pair of laterally spaced side walls; and a closed top secured between said pair of laterally spaced side walls so as to form a generally closed wall structure with the exception of said opening about the lower end of said divider assembly; and wherein said air outlet opening means is provided within each of said laterally spaced side walls of said wall structure such that air moving into said air inlet opening and through the open interior of said wall structure may exit through said air outlet opening means formed in said wall structure of said divider assembly such that air is directed generally outwardly from the divider assembly and generally upwardly through the tobacco material disposed centrally within said container.

* * * * *